US008517212B2

(12) United States Patent
Antal, Sr.

(10) Patent No.: US 8,517,212 B2
(45) Date of Patent: Aug. 27, 2013

(54) OVERCAP FOR A CONTAINER

(75) Inventor: Keith E. Antal, Sr., Valatie, NY (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 13/101,289

(22) Filed: May 5, 2011

(65) Prior Publication Data

US 2012/0279969 A1 Nov. 8, 2012

(51) Int. Cl.
*B65D 43/24* (2006.01)
*B65D 51/18* (2006.01)

(52) U.S. Cl.
USPC ..... 220/832; 220/254.3

(58) Field of Classification Search
USPC ..... 220/832, 831, 826, 836, 810, 254.6, 220/254.3, 254.1, 259.2, 256.1, 259.1, 212, 220/FOR. 207, FOR. 203, FOR. 193, FOR. 196, 220/FOR. 192, 525, 524, 523, 200, 712, 711, 220/380; 206/508; 222/556
IPC ..... B65D 43/16, 43/24, 43/14, 51/18
See application file for complete search history.

(56) References Cited

U.S. PATENT DOCUMENTS

| | | | | |
|---|---|---|---|---|
| 677,466 | A * | 7/1901 | Ortner | 210/245 |
| 3,155,285 | A | 11/1964 | Baarn | |
| 3,262,606 | A | 7/1966 | Waterman | |
| 3,272,379 | A | 9/1966 | Driza et al. | |
| 3,412,890 | A | 11/1968 | Rich | |
| 3,417,897 | A | 12/1968 | Johnson | |
| 3,421,654 | A | 1/1969 | Hexel | |
| 4,202,459 | A * | 5/1980 | DeParales et al. | 220/712 |
| 4,369,901 | A | 1/1983 | Hidding | |
| 4,718,567 | A | 1/1988 | LaVange | |
| 4,759,478 | A * | 7/1988 | Richardson et al. | 222/556 |
| 4,881,668 | A | 11/1989 | Kitterman et al. | |
| 4,949,865 | A | 8/1990 | Turner | |
| 5,392,949 | A * | 2/1995 | McKenna | 220/712 |
| 5,490,609 | A * | 2/1996 | Lane et al. | 220/712 |
| 5,706,981 | A | 1/1998 | Nobakht | |
| 5,791,508 | A | 8/1998 | Arnould | |
| 6,412,637 | B1 | 7/2002 | Saunders et al. | |
| 6,471,083 | B1 | 10/2002 | Helms | |
| 6,523,713 | B1 | 2/2003 | Helms | |
| 6,575,323 | B1 | 6/2003 | Martin et al. | |
| 6,910,623 | B2 | 6/2005 | Stewart et al. | |
| 6,986,434 | B1 | 1/2006 | Getsy et al. | |
| 7,150,380 | B2 | 12/2006 | Hoepner et al. | |
| 7,165,695 | B2 | 1/2007 | Choi | |
| 2005/0167430 | A1 | 8/2005 | Varadarajan | |
| 2005/0236465 | A1 | 10/2005 | Stevens | |
| 2007/0045140 | A1 | 3/2007 | Klein | |
| 2007/0257044 | A1 | 11/2007 | Stevens | |
| 2008/0245792 | A1 | 10/2010 | Chou | |

FOREIGN PATENT DOCUMENTS

| | | |
|---|---|---|
| WO | WO 2008-103343 | 8/2008 |

* cited by examiner

*Primary Examiner* — Robert J Hicks
(74) *Attorney, Agent, or Firm* — Flaster/Greenberg, P.C.

(57) ABSTRACT

An overcap is provided and forms a closure for at least a portion of an access opening on the container. A stand-off rim is formed on the upper surface of the overcap adjacent the peripheral edge. The overcap includes a closure body. A sealing flap is pivotally attached to the closure body and movable between a first position for covering the container access opening and a second position for exposing the access opening. A projection is positioned adjacent the stand-off rim on the closure body and defines a receiving gap for receipt and frictional engagement of the stand-off rim on the sealing flap in the open position. The frictional engagement of the sealing flap releasably retaining the sealing flap in the open second position.

20 Claims, 4 Drawing Sheets

OVERCAP FOR A CONTAINER

FIELD OF THE INVENTION

The present invention relates generally to a cap for a container.

BACKGROUND OF THE INVENTION

Often, containers that store perishable products, such as food, include a removable membrane sealed to the rim of the container. The membrane is used to help prevent the transfer of oxygen, moisture and other contaminants into the container. The membrane also provides a measure of tamper evidency. When a consumer buys the container, the membrane is removed and discarded. The container can then be used to dispense the product.

It is known to include a removable overcap to protect the product and to provide access to the product retained within a container. For example, U.S. Pat. No. 4,718,567 to LaVange shows an overcap for an open-mouthed container. The cap has two annular skirts, with one skirt including an inwardly projecting rib that engages a rim on the container to retain the cap on the container. The inner skirt is sized to fit within the open end of the container, positioning the rim between the two skirts. The cap also includes a hinged flap that selectively closes an opening in the overcap.

US 2005/0236465 to Stevens shows an overcap with an outer annular skirt adapted to engage the rim of a container. A hinge is provided across a top panel of the overcap to allow a portion of the top panel to be selectively rotated with respect to the remaining portions of the top panel to provide access to the product within the container. The skirt portion includes an inwardly extending rib that engages the container rim to secure the overcap to the container. The hinged portion of the overcap can be opened by moving the rib on the hinged portion over the rim of the container.

It is known to provide structures on an overcap to fix a portion of the overcap in an open position. U.S. Pat. No. 6,471,083 to Helms shows an overcap and container combination, with the overcap having a pivotable portion for providing access into the container. In one embodiment, a set of two male tabs on both side edges of the body portion of the overcap and a corresponding tab on each side edge of a flap portion. When the flap portion is rotated back, the single tab engages within a slot created by the tabs and the flap is fixed in the open position.

U.S. Pat. No. 5,706,981 to Nobakht shows a dispensing overcap for closing a container. The overcap includes three pivotable flaps for covering different sets of openings. Each flap includes a single upstanding post on its upper surface. Adjacent each flap pivot is provided a pair of posts, defining a slot. The flap post is positioned to engage within the slot of the adjacent post pairs when the flap portion is pivoted open.

It is also known to use contoured surfaces on the opposing flap sections of a pivotable overcap structure to hold a flap open. U.S. Pat. No. 7,165,695 to Choi and US 2007/0045140 to Klein show overcaps for containers having a pair of pivotable flaps formed on opposite ends of the upper surface. One flap forms an elongated slot and the opposing flap forms an elongated projection that frictionally mate together when one of the flaps is rotated to the open position.

U.S. Pat. No. 4,369,901 to Hidding and U.S. Pat. No. 6,575,323 to Martin et al show pivotable flaps on an overcap structure having a releaseably locking mechanism adjacent the pivot position. A projection formed on an inside edge of the flap pivot engages within a receiving slot on the body of the overcap to fix the flap in an open position.

SUMMARY OF THE INVENTION

An overcap for a container is provided. The overcap forms a closure for at least a portion of an access opening on the container. The overcap closure includes a closure body for covering at least a portion of a container access opening. The closure body includes an upper surface and is defined at least in part by a peripheral edge. A stand-off rim is formed on the upper surface of the closure body and is preferably positioned in a spaced relationship with the peripheral edge. A sealing flap is pivotally attached to the closure body and movable between a first position for at least partially covering the container access opening adjacent the closure body and a second position for exposing the access opening. The sealing flap also includes an upper surface. Retaining means is provided for releasably securing the sealing flap to the closure body in the second position. The retaining means includes a first portion and a second portion. The first portion projects from the upper surface of the sealing flap and the second portion is formed on the closure body. The second portion includes a projection spaced from a portion of the stand-off rim on the closure body and defines a receiving gap. The gap is positioned for receipt and engagement of the first portion on the sealing flap. The dimensional relationship of the gap between the projection and the stand-off rim creates a frictionally engagement of the projecting first portion of the flap, to releasably retain the sealing flap in the open position. Preferably, the first portion is formed as part of the stand-off rim on the sealing flap.

In another aspect of the contemplated overcap closure, the closure body is relatively larger than the sealing flap. Preferably, the second portion is positioned inwardly of the stand-off rim on the upper surface of the closure body. Furthermore, the closure body may comprise a depending sealing flange formed on the peripheral edge of the closure body. The sealing flange may be formed to engage the periphery of the access opening of the container for retaining the closure body in the covering position. The sealing flange may be integrally formed with the upper surface of the closure body.

In another aspect of the contemplated overcap closure, the sealing flap may comprise a depending sealing flap flange provided at the peripheral edge of the sealing flap and formed to engage the periphery of the access opening of the container for retaining the sealing flap in the covering position for the access opening in the first position. The sealing flap may also include a flange, integrally formed with the upper surface of the sealing flap. The flange that pivots along with the sealing flap between the first position and the second position.

The contemplated invention may also be provided as a combination of a container and an overcap. The container is provided for storing a product and defines a receptacle having a bottom wall, at least one sidewall and an access opening. The overcap may be releasably or permanently attached to the container so as to cover at least a portion of the access opening. The overcap includes a first portion and a second portion. A hinge connects the first and second portion, enabling the one portion to rotate about the hinge relative to the other portion between a first position, wherein the first and second portion cover the access opening, and a second position, wherein the one portion is pivoted to provide access to the material in the receptacle through the access opening. Each overcap portion preferably includes a raised stand-off rim positioned adjacent its periphery and includes projections thereon for frictionally fixing the first portion to the second portion in the open second position.

BRIEF DESCRIPTION OF THE DRAWINGS

There is shown in the drawings a number of embodiments that are presently contemplated. Reference should be made to the description of these embodiments as well as the claims that follow for defining the scope of the invention.

DETAILED DESCRIPTION OF THE DRAWINGS

Figure 1:
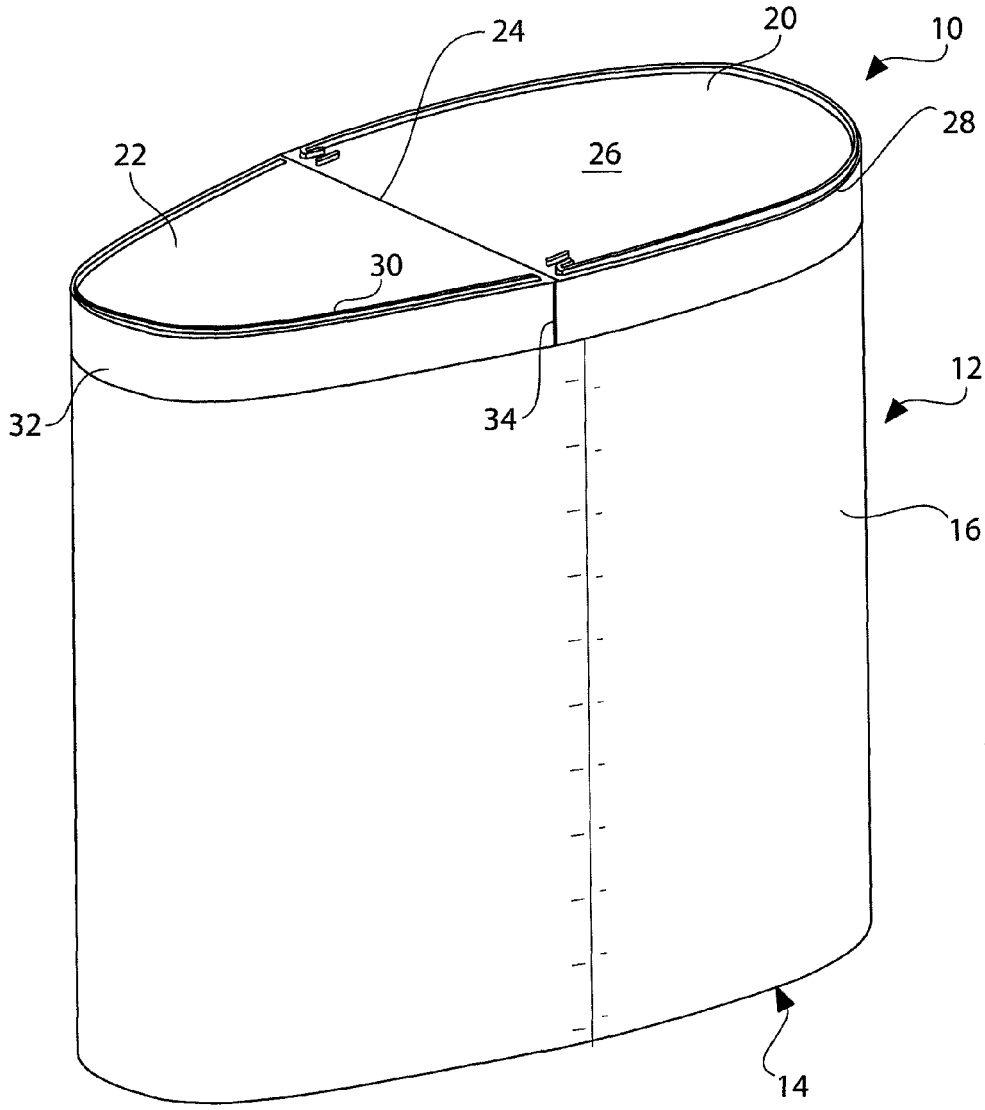
FIG. 1 shows a perspective view of a combination overcap and container.
Figure 2:
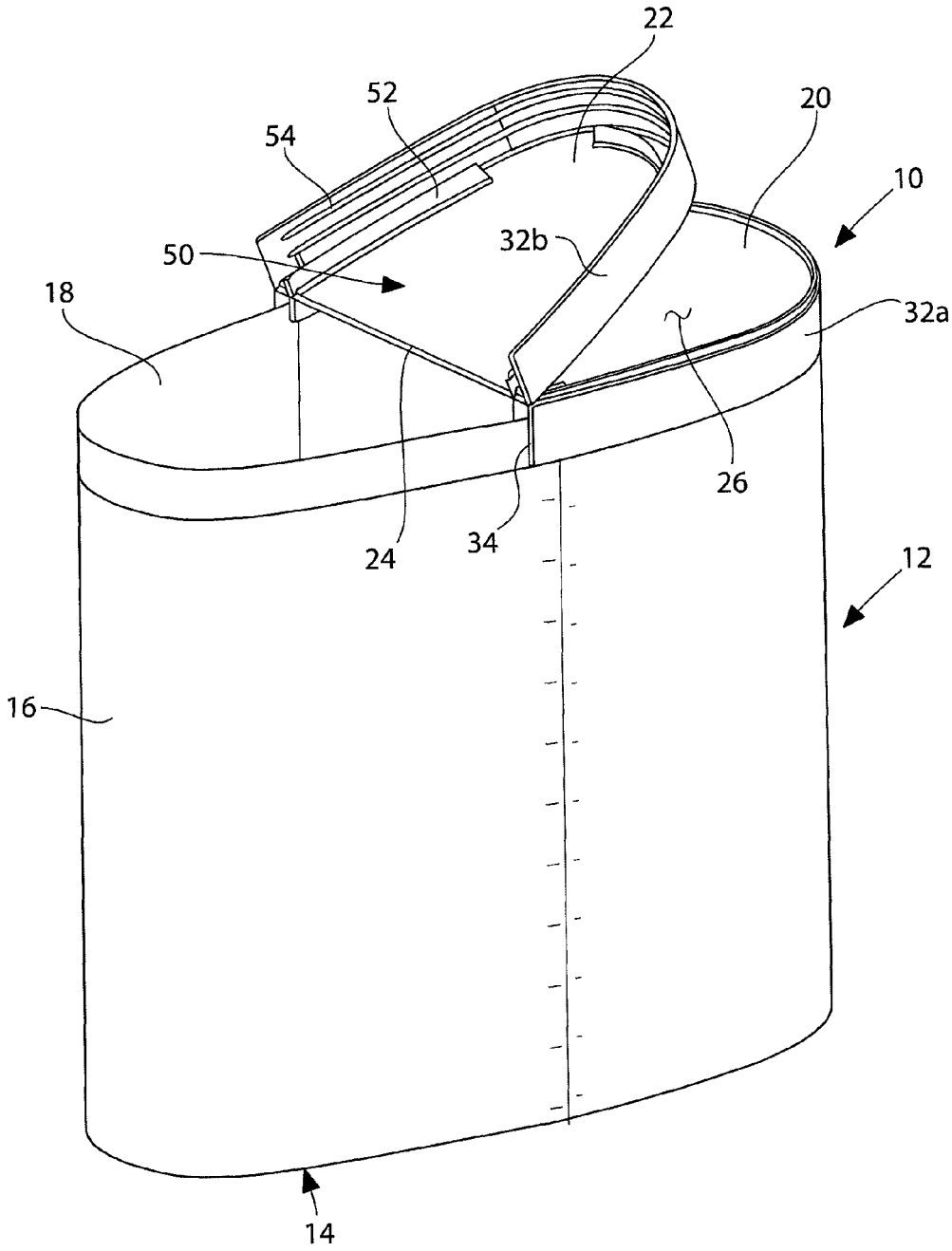
FIG. 2 shows a perspective view of the overcap and container of FIG. 1 wherein a portion of the overcap is moved to an open and locked position.

In the drawings, where like numerals identify like elements, there is shown an overcap and container combination. In FIG. 1, the overcap is generally referred to by the numeral 10 and the container is designated by the numeral 12. The container body 12 comprises a hollow reservoir defined by a bottom wall 14, an upstanding side wall 16 and, as shown in FIG. 2, and an access opening 18. An upper rim is defined at the upper end of the side wall 16 at the access opening 18. A removable membrane (not shown) may be attached to the rim to seal the reservoir defined by the container body 12. The upper rim of the container 12 may be formed by a rolled portion of the sidewall 16. However the rim may have a different form or may be made by a separately attached element, such as a crimped bead (not shown).

Referring to FIGS. 1 and 2, the overcap 10 is divided into two portions 20, 22 by a hinge 24. The hinge 26 bisects the overcap 10 into a closure body portion 20 and a sealing flap portion 22. As shown in the drawings, the closure body 20 remains attached to the rim of the container 12, with the sealing flap 22 being movable relative to the body portion 20 about the hinge 24. However, additional portions may be included in the overcap and more than one portion may be pivotable about one or more hinge structures. Alternatively, only a portion of the overcap may be pivotable with respect to other portions of the cap. The overcap 10 is preferably integrally molded with the hinge 24 formed as a living hinge, connecting the two portions 20, 22 together. In FIG. 2, the sealing flap portion 22 is shown in the open position, exposing the access opening 18 into the container body 12.

In FIG. 1, the overcap 10 is in a first or sealing position, covering or sealing the access opening of the container 12. Each portion 20, 22 of the overcap 10 includes an upper surface 26, a peripheral edge 28, a stand-off rim 30 and a depending flange 32. The upper surface 26 of the overcap 10 serves to cover the access opening 18, when the overcap 10 is positioned on the rim of the container 12. The depending flange 32 is shown to overlap with the upper end of the sidewall 16 of the container 12, preferably, forming a sealing arrangement for the product retained within the reservoir defined by the container 12.

As shown in FIG. 2, the overcap 10 is in a second or open position, with the sealing flap 22 pivoted relative to the body portion 20. In the open position, with the flap 22 pivoted, access is provided to the product within the reservoir of the container 12, through the access opening 18. The sealing flap 22 pivots about the hinge 24 and the body portion 20 remains attached to the rim of the container 12. A body portion 32*a* of the depending flange 32, preferably, remains fixed to the container 12 during the pivoting of the sealing flap 22. A flap portion 32*b* of the depending flange 32 is preferably integrally formed with the flap 22 and, as shown, pivots with the flap 22. A separation line 34 is defined in the flange 32 to permit the separation of the two flange portions 32*a*, 32*b*.

Figure 3:
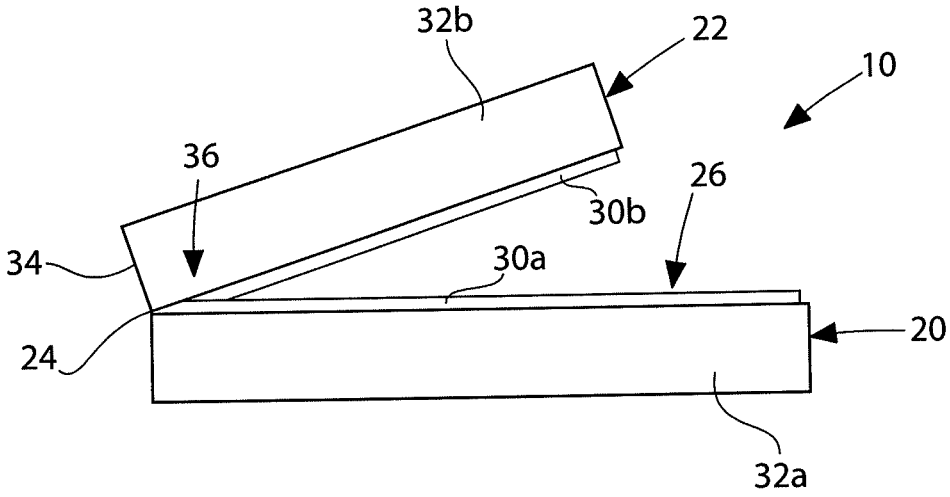
FIG. 3 shows a side elevational view of the overcap of FIGS. 2 in the open position and locked.

In FIG. 3, the overcap 10 is shown in the second or open position, with the sealing flap 22 pivoted about the hinge 24 toward the body portion 20. Further, the sealing flap 22 is fixed in the open position by a retaining means 36 formed on the upper surface 26 of the overcap 10. The retaining means 36 is formed in part by the interaction of the separate portions 30*a*, 30*b* of the stand-off rim 30.

Figure 4:
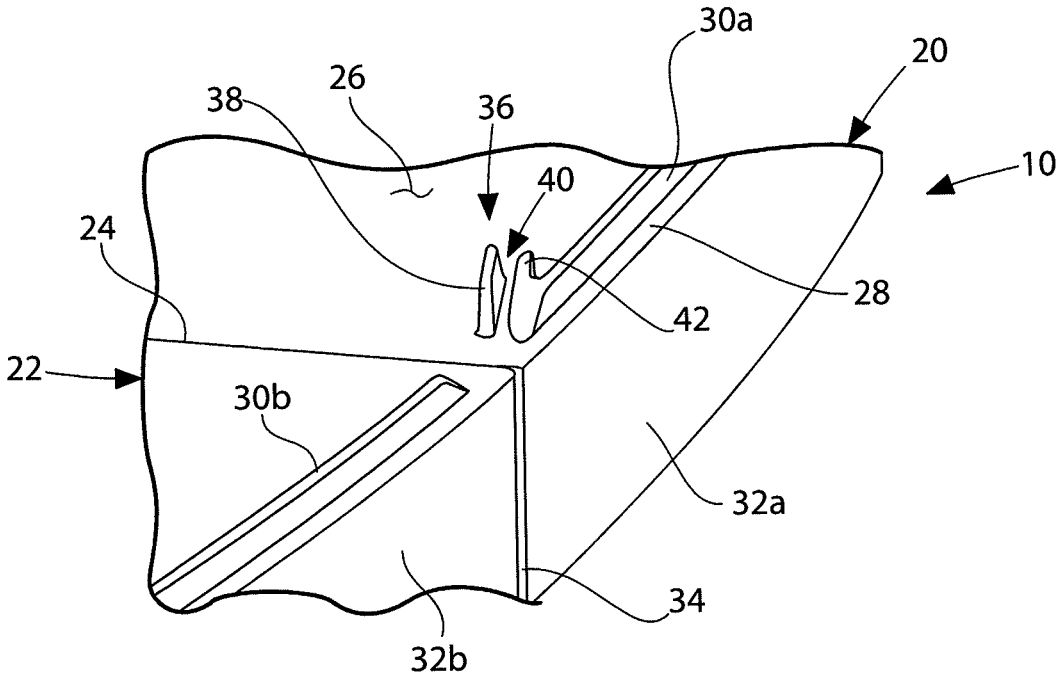
FIG. 4 shows an enlarged front perspective view of a portion of the overcap of FIGS. 1-3, with the overcap in the closed position.
Figure 5:
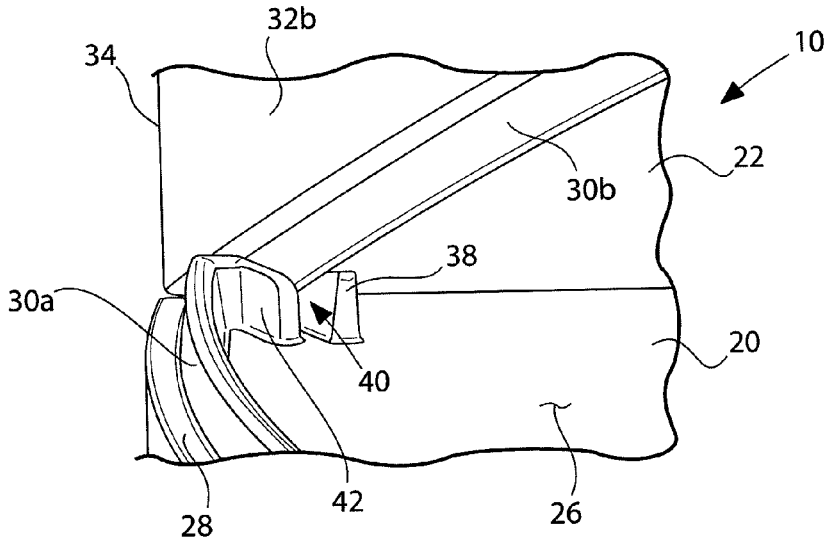
FIG. 5 shows an enlarged rear perspective view of a portion of the overcap of FIGS. 1-3, with the overcap in the open and fixed position.

In FIGS. 4 and 5, there is shown a close-up of a portion of the peripheral edge 28 of the upper surface 26 of the overcap 10, adjacent the hinge 24. It is contemplated that the opposite side of the hinge includes a similar structure, positioned adjacent the opposite side edge of the overcap. The retaining means 36, as shown, is formed by a combination of the portions 30*a*, 30*b* of the stand-off rim 30 and a separate projection 38 formed on the upper surface 26 of the body portion 20. The projection 38 is positioned closely adjacent the inside edge 42 of the stand-off rim portion 30*a* on the closure body 20. The projection 38 and rim portion 30*a* define a receiving gap 40. In the embodiment of FIG. 4, the inside edge 42 of the rim portion 30*a* angles inwardly from the main portion of the rim. As shown in FIG. 5, the projection 38 and edge portion 42 position the gap 40 for receipt of the flap stand-off portion 30*b*. Further, the size of the gap 40 is formed to create a engagement of the rim portion 30*b* on the sealing flap 22. The frictional retention of the rim 30*b* within the receiving gap 40 fixes the sealing flap 22 in the open position, as shown in FIG. 3.

Figure 6:
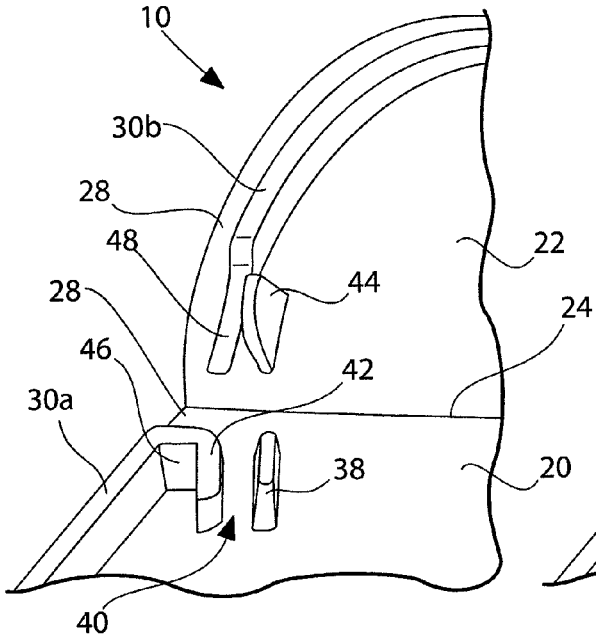
FIG. 6 shows a rear perspective view of a portion of the alternate embodiment of an overcap, with the overcap in the open position, prior to engagement.

In the embodiment of FIG. 6, a flap projection 44 is provided on the upper surface of the sealing flap 22. The flap projection 44 is positioned inward of the stand-off rim 30*b*. The inside edge 42 of the stand-off rim portion 30*a* on the closure body 20 is connected to an edge extension 46. The edge extension 46 connects the stand-off rim 30*a* with the inside edge 42 and permits the inside edge 42 to be positioned relatively further inward from the peripheral edge 28 of the closure body 20, as compared to the embodiment of FIGS. 4 and 5. The end portion 48 of the stand-off rim portion 30*b* on the sealing flap 22 is tapered 48 to minimize interference with the inside edge 42, edge extension 46 and/or stand-off rim portion 30*a* on the closure body portion 20. The flap projection 44 is formed to engage within the receiving gap 40 between the inside edge 42 and the closure projection 38 and is preferably retained therein by friction.

Figure 7:
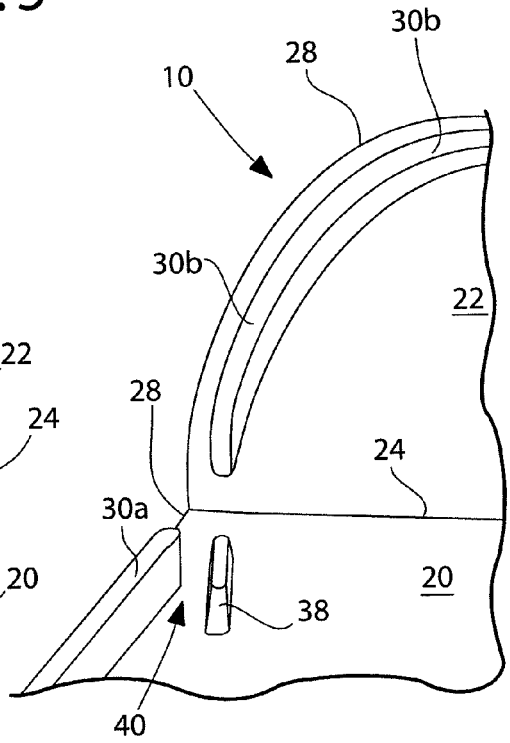
FIG. 7 shows a rear perspective view of a portion of an alternate embodiment of an overcap, with the overcap in the open position, prior to engagement.

In the embodiment of FIG. 7, the inside edge 42 of the stand-off rim 30*a* on the closure body 20 is formed, without any extension of the rim 30*a*, such as in FIGS. 4-5 or the extension 46 in FIG. 6. The closure projection 38 forms a receiving gap 40 with the inside edge 42. The stand-off rim portion 30*b* on the sealing flap 22 is positioned to fit in the gap 40, when the sealing flap 22 is pivoted into the open and engaged position as shown in FIG. 3. This direct embodiment serves to reduce the complexity of the mold and reduce the material used in creating the overcap.

In the embodiments shown, as more particularly illustrated in FIG. 1, the upper surface 26 is relatively broader at the closure body 20 than at the sealing flap 22. This form matches the dimensions of the container 12. The narrow end of the container serves in part as a spout for pouring product from the reservoir, when the sealing flap 22 is in the open position. The retaining means is intended to retain the sealing flap 22 in the open position, so that pouring (or other access to the reservoir) may be accomplished without separately holding the flap open. The form of the spot and flap helps in part to position the stand-off rim 30*b* on the sealing flap 22 inward of the stand-off rim 30*a* on the closure body 20, when the sealing flap 22 is rotated to the second position and into close contact with the closure body 20 (FIG. 3). The alignment of the receiving gap 40 is further assisted by the positioning of the inside edge 42 and the projection 38. Other forms and shapes for the overcap and the container are contemplated for use along with features of the present invention.

The stand-off rim 30 is of the type typically provided on overcaps. The rim is used for locating containers in a stacked relationship, due to an undercut on the bottom surface (14) of the containers. The rim is also used for stacking overcaps on top of one another for storage or shipment, before attachment to the container. The rim may also serve to stiffen the overcap. Other forms of the stand-off rim may be provided and the positioning of the rim may be adjusted in creating the features of the present invention.

As shown in the figures, the depending flange engages the outside surfaces of the upper rim of the container 12. It is contemplated that the overcap may be engaged the container access opening in a number of other ways, may engage the inside surface or rim of the container access opening, or may be attached to a container. As partially shown in FIG. 2, the inside portion 50 of the sealing flap 22 may include structures for engagement of the flap 22 (or the overcap 10 as a whole) to the container rim at the access opening 18. As shown, a plurality of supports 52 are provided for engagement of the inside surface of the container rim. Inside ribs 54 are also provided for engagement with the outside surfaces of the rim. The ribs 54 may be used for a press-fit engagement of a bead (not shown) on the container rim or of the outside surfaces of the sidewall 16.

In the description above, the covering or closure portion for the container is refered to as an overcap. Other names and descriptions may be used to refer to the closure, such as lid, cap, etc. Further, the access opening on the container may take alternate forms and need not be positioned on the top end of the container.

The above features of the overcap and container can be made of any suitable material including but not limited to paper, plastic or metal. Further, other variations and modifications of the structure as illustrated and discussed herein will be apparent to those skilled in the art upon reading the present description. The invention may be embodied in other specific forms without departing from the spirit or essential attributes thereof Thus, the scope of the impending claims should not be limited by the description of the preferred versions contained herein.

What is claimed is:

1. A closure for a container having at least one access opening therein, the closure comprising:

a closure body adapted to cover at least a portion of the container access opening, the closure body having an upper surface and a peripheral edge, an upstanding stand-off rim surrounding the upper surface of the closure body in a closely spaced relationship with the peripheral edge, a sealing flap pivotably attached to the closure body and movable between a first position at least partially covering the container access opening adjacent the closure body and a second position exposing the access opening, the sealing flap having an upper surface and an upstanding flap stand-off rim formed thereon, and a retainer for releasably securing the sealing flap to the closure body in the second position, a first projection on the upper surface of the closure body, the first projection being spaced from a portion of the stand-off rim on the closure body, the space between the first projection and the portion of the closure body stand-off rim aligned and dimensioned for receiving and engagement of the flap stand-off rim on the sealing flap for frictionally retaining the sealing flap in the open second position.

2. The closure of claim 1, wherein the closure body is relatively larger than the sealing flap.

3. The closure of claim 1, wherein the first projection is positioned inwardly of the stand-off rim on the upper surface of the closure body.

4. The closure as in claim 1, wherein the closure body comprises a depending sealing flange formed on the peripheral edge of the closure body, the sealing flange formed to engage the periphery of the access opening of the container for retaining the closure body in the covering position.

5. The closure as in claim 4 wherein the sealing flange is integrally formed with the upper surface of the closure body.

6. The closure as in claim 4, wherein the sealing flap comprises a depending sealing flap flange provided at the peripheral edge of the sealing flap, the sealing flange formed to engage the periphery of the access opening of the container for retaining the sealing flap in the covering position for the access opening in the first position.

7. The closure as in claim 6, wherein the sealing flap flange is integrally formed with the upper surface of the sealing flap and pivots along with the sealing flap between the first position and the second position.

8. The closure as in claim 1, wherein the portion of the stand-off rim on the closure body comprises a rim extension formed inwardly of an adjacent portion of the closure body stand-off rim, the rim extension defining with the first projection the receiving space.

9. A closure for a container having at least one access opening therein, the closure comprising:

a closure body adapted to cover at least a portion of a container access opening, the closure body having an upper surface and a peripheral edge, a sealing flap pivotably attached to the closure body and movable between a first position at least partially covering the container access opening adjacent the closure body and a second position exposing the access opening, the sealing flap having an upper surface, a stand-off rim surrounding the upper surface of the closure body and positioned adjacent the peripheral edge of the closure body, and a retainer for frictionally, and releasably securing the sealing flap to the closure body in the second position, the retainer having a first portion and a second portion, the first portion projecting from the upper surface of the sealing flap, and the second portion projecting from the closure body adjacent the stand-off rim, the stand-off rim and the second portion defining a receiving gap, and the retainer positioned for receipt and engagement of the first portion within the receiving gap for frictionally retaining the sealing flap in the open second position.

10. The closure of claim 9, wherein the closure body is relatively larger than the sealing flap.

11. The closure as in claim 9, wherein the closure body comprises a depending sealing flange formed on the peripheral edge of the closure body, the sealing flange formed to engage the periphery of the access opening of the container for retaining the closure body in the covering position.

12. The closure as in claim 11, wherein the sealing flange is integrally formed with the upper surface of the closure body.

13. The closure as in claim 11, wherein the sealing flap comprises a depending sealing flange provided at the peripheral edge of the sealing flap, the sealing flange formed to engage the periphery of the access opening of the container for retaining the sealing flap in the covering position for the access opening in the first position.

14. The closure as in claim 13, wherein the sealing flange is integrally formed with the upper surface of the sealing flap and pivots along with the sealing flap between the first position and the second position.

15. The closure as in claim 9, further comprising a flap stand-off rim positioned adjacent a peripheral edge of the sealing flap.

16. The closure as in claim 15, wherein the first portion is provided on the sealing flap inwardly of the flap stand-off rim and wherein the receiving gap is formed inwardly of the stand-off rim on the closure body.

17. The closure as in claim 9, wherein the receiving gap is defined between an inwardly positioned extension of the closure body stand-off rim and the second portion.

18. A container and overcap combination for storing product, comprising:

a) a container receptacle having a bottom wall, at least one sidewall, and an access opening;

b) an overcap attached to container over the access opening, the overcap having i) a first cap portion, ii) a second cap portion; and iii) a hinge connecting the first and second cap portions, enabling the first portion to rotate about the hinge relative to the second portion between a first position, wherein the first and second portions cover the access opening, and a second position wherein the first cap portion is pivoted away from the access opening, c) each cap portion having a raised stand-off rim, each raised stand-off rim positioned around the upper surface and closely adjacent a periphery of the upper surface of the respective cap portion, and d) a projection formed adjacent the stand-off rim on the second cap portion, the stand-off rim on the second cap portion and the projection defining a receiving gap for frictionally receiving the stand-off rim of first cap portion and fixing the first cap portion in the open position.

19. A container and overcap combination as in claim 18, wherein one of the cap portions is larger than the other.

20. A container and overcap combination as in claim 18, wherein each cap portion comprises a downwardly depending sealing flange that extends from the periphery of the upper surface of the cap portion and covers the rim of the side wall of the container adjacent the access opening.

* * * * *